US010249264B2

(12) United States Patent
Hu et al.

(10) Patent No.: US 10,249,264 B2
(45) Date of Patent: Apr. 2, 2019

(54) CONTROLLER FOR COMPENSATING MURA DEFECTS, DISPLAY APPARATUS HAVING THE SAME, AND METHOD FOR COMPENSATING MURA DEFECTS

(71) Applicants: BOE TECHNOLOGY GROUP CO., LTD., Beijing (CN); BEIJING BOE DISPLAY TECHNOLOGY CO., LTD., Beijing (CN)

(72) Inventors: Weihao Hu, Beijing (CN); Luqiang Guo, Beijing (CN); Wengang Su, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 195 days.

(21) Appl. No.: 15/501,851

(22) PCT Filed: Jun. 7, 2016

(86) PCT No.: PCT/CN2016/085094
§ 371 (c)(1),
(2) Date: Feb. 5, 2017

(87) PCT Pub. No.: WO2017/016322
PCT Pub. Date: Feb. 2, 2017

(65) Prior Publication Data

US 2017/0243562 A1 Aug. 24, 2017

(30) Foreign Application Priority Data

Jul. 27, 2015 (CN) ..... 2015 1 0446103

(51) Int. Cl.
*G09G 5/10* (2006.01)
*G09G 3/20* (2006.01)

(52) U.S. Cl.
CPC ..... *G09G 5/10* (2013.01); *G09G 3/2092* (2013.01); *G09G 2320/029* (2013.01);
(Continued)

(58) Field of Classification Search
CPC combination set(s) only.
See application file for complete search history.

(56) References Cited

U.S. PATENT DOCUMENTS

2007/0047801 A1* 3/2007 Kojima ..... G06T 7/0004 382/149
2007/0091042 A1* 4/2007 Chung ..... G09G 3/3648 345/88

(Continued)

FOREIGN PATENT DOCUMENTS

CN 1482797 A 3/2004
CN 1571011 A 1/2005

(Continued)

OTHER PUBLICATIONS

International Search Report & Written Opinion dated Sep. 8, 2016 regarding PCT/CN2016/085094.

*Primary Examiner* — Jennifer Mehmood
*Assistant Examiner* — Deeprose Subedi
(74) *Attorney, Agent, or Firm* — Intellectual Valley Law, P.C.

(57) ABSTRACT

The present application discloses a method for compensating mura defects in a display image, the method includes obtaining a plurality of display data and a plurality of address data corresponding to a plurality of display pixels; and determining if a pixel is a sampling pixel based on a data table comprising a plurality of compensation data associated with a plurality of compensation points for compensating a plurality of sampling pixels, each compensation point corresponding to a group of at least one sampling pixel, the plurality of sampling pixels comprising a plurality of display (Continued)

pixels having mura defects and constituting a portion of the plurality of display pixels.

15 Claims, 8 Drawing Sheets

(52) U.S. Cl.
CPC ..... *G09G 2320/0233* (2013.01); *G09G 2320/0271* (2013.01); *G09G 2330/10* (2013.01); *G09G 2330/12* (2013.01)

(56) References Cited

U.S. PATENT DOCUMENTS

| | | | | |
|---|---|---|---|---|
| 2009/0146939 | A1 | 6/2009 | Hirayama et al. | |
| 2010/0007656 | A1* | 1/2010 | Okamoto ..... | G09G 3/3233 345/214 |
| 2013/0342585 | A1 | 12/2013 | Chun et al. | |

FOREIGN PATENT DOCUMENTS

| | | | |
|---|---|---|---|
| CN | 101105930 | A | 1/2008 |
| CN | 101996618 | A | 3/2011 |
| CN | 103489420 | A | 1/2014 |

* cited by examiner

CONTROLLER FOR COMPENSATING MURA DEFECTS, DISPLAY APPARATUS HAVING THE SAME, AND METHOD FOR COMPENSATING MURA DEFECTS

CROSS-REFERENCE TO RELATED APPLICATION

This application is a national stage application under 35 U.S.C. § 371 of International Application No. PCT/CN2016/085094, filed Jun. 7, 2016, which claims priority to Chinese Patent Application No. 201510446103.5, filed Jul. 27, 2015, the contents of which are incorporated by reference in the entirety.

TECHNICAL FIELD

The present invention relates to image display techniques, more particularly, to a controller for compensating mura defects, a display apparatus having the same, and a method for compensating mura defects.

BACKGROUND

A mura defect is a display non-uniformity on an image display including a non-uniformity in luminance, hue and tone. For example, a mura defect may be a contrast-type defect where one or more pixels is brighter or darker than surrounding pixels, when they should have uniform luminance. When an intended flat region of color is displayed, various imperfections in the display components may result in undesirable modulations of the luminance. FIG. 1 is an image displayed by a display panel having mura defects. Referring to FIG. 1, the actual displayed luminance deviates from theoretical luminance in regions having mura defects. The regions having mura defects are darker than the regions not having mura defects. Similarly, in some cases, the regions having mura defects may be brighter than the regions not having mura defects.

SUMMARY

In one aspect, the present invention provides a method for compensating mura defects in a display image, the method comprising obtaining a plurality of display data and a plurality of address data corresponding to a plurality of display pixels; and determining if a pixel is a sampling pixel based on a data table comprising a plurality of compensation data associated with a plurality of compensation points for compensating a plurality of sampling pixels, each compensation point corresponding to a group of at least one sampling pixel, the plurality of sampling pixels comprising a plurality of display pixels having mura defects and constituting a portion of the plurality of display pixels.

Optionally, prior to the step of obtaining the plurality of display data and the plurality of address data, the method further comprises providing a plurality of testing display data to the plurality of display pixels for displaying a plurality of pixels of an image; measuring a luminance of each pixel of the image; calculating a luminance difference between a measured luminance and a theoretical luminance for each pixel; determining a pixel to be a pixel having mura defect if the luminance difference is larger than a threshold value; selecting the plurality of sampling pixels; and generating the plurality of compensation data associated with the plurality of compensation points based on the luminance difference for each pixel.

Optionally, the method further comprises compensating a display data of the sampling pixel by assigning a compensation value to the group of at least one sampling pixel based on a compensation data associated with a compensation point corresponding to the group of at least one sampling pixel.

Optionally, the step of selecting the plurality of sampling pixels comprises selecting at least one polygon region to include all pixels determined to have mura defects, pixels within the at least one polygon region are defined as the plurality of sampling pixels.

Optionally, the step of determining if a pixel is a sampling pixel comprises determining if the pixel is within the at least one polygon region based on the address data of the pixel.

Optionally, the data table comprises a plurality of addresses data associated with a plurality of compensation points corresponding to pixels at vertex points of the at least one polygon region.

Optionally, each of the at least one polygon region is selected to encompass a single continuous area of pixels determined to have mura defects.

Optionally, each of the at least one polygon region is selected to encompass one or more isolated areas of pixels determined to have mura defects if a distance between the isolated areas is less than a threshold distance.

Optionally, the step of selecting the plurality of sampling pixels comprises selecting a group of pixels consisting of all pixels determined to have mura defects as the plurality of sampling pixels.

Optionally, the step of determining if a pixel is a sampling pixel comprises matching the address data of the pixel with those of the plurality of compensation points.

Optionally, each group of at least one sampling pixel consists of one sampling pixel.

In another aspect, the present invention provides a display method for displaying an image on a display panel comprising obtaining a plurality of display data and a plurality of address data corresponding to a plurality of display pixels; determining if a pixel is a sampling pixel based on a data table comprising a plurality of compensation data associated with a plurality of compensation points for compensating a plurality of sampling pixels, each compensation point corresponding to a group of at least one sampling pixel, the plurality of sampling pixels comprising a plurality of display pixels having mura defects and constituting a portion of the plurality of display pixels; compensating a display data of the sampling pixel by assigning a compensation value to the group of at least one sampling pixel based on a compensation data associated with a compensation point corresponding to the group of at least one sampling pixel; and displaying an image at each of the plurality of sampling pixels using a compensated display data, and at each of pixels other than sampling pixels using a display data.

In another aspect, the present invention provides a controller for compensating mura defects in a display image comprising a collection sub-controller for obtaining a plurality of display data and a plurality of address data corresponding to a plurality of display pixels; a storage sub-controller for storing a data table comprising a plurality of compensation data associated with a plurality of compensation points for compensating a plurality of sampling pixels, each compensation point corresponding to a group of at least one sampling pixel, the plurality of sampling pixels comprising a plurality of display pixels having mura defects and constituting a portion of the plurality of display pixels; a judgment sub-controller coupled to the collection controller for receiving the plurality of address data, and coupled to the storage sub-controller for determining if a pixel is a sampling pixel; and a compensation sub-controller coupled to the storage sub-controller, the judgment sub-controller, and the collection sub-controller for compensating a display data of the sampling pixel by assigning a compensation value to the group of at least one sampling pixel based on a compensation data associated with a compensation point corresponding to the group of at least one sampling pixel.

Optionally, the plurality of sampling pixels outline at least one polygon region, wherein the data table comprises a plurality of addresses data associated with a plurality of compensation points corresponding to pixels at vertex points of the at least one polygon region.

Optionally, the at least one polygon region is at least one rectangular region.

Optionally, the judgment sub-controller is configured to determine the pixel to be the sampling pixel if the pixel is within the at least one polygon region based on the address data of the pixel.

Optionally, each of the at least one polygon region is configured to encompass a single continuous area of pixels determined to have mura defects.

Optionally, each of the at least one polygon region is configured to encompass one or more isolated areas of pixels determined to have mura defects if a distance between the isolated areas is less than a threshold distance.

Optionally, the plurality of sampling pixels consist of the plurality of display pixels having mura defects, and the data table comprises a plurality of address data associated with the plurality of compensation points corresponding to the plurality of sampling pixels.

Optionally, the number of display pixels having mura defects is no greater than 50% of the number of the plurality of display pixels.

Optionally, the judgment sub-controller is configured to determine the pixel to be the sampling pixel by matching the address data of the pixel with those of the plurality of compensation points.

Optionally, the display data comprises a grayscale value.

Optionally, the compensation value comprises a correction value to be added to the display data for compensating mura defects of the sampling pixel.

Optionally, the compensation value comprises a correction factor to be multiplied with the display data for compensating mura defects of the sampling pixel.

Optionally, each group of at least one sampling pixel consists of one sampling pixel.

In another aspect, the present invention provides a display apparatus comprising a controller as described herein, and a display panel for displaying an image; wherein the display panel is configured to display the image at each of the plurality of sampling pixels using a compensated display data.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now describe more specifically with reference to the following embodiments. It is to be noted that the following descriptions of some embodiments are presented herein for purpose of illustration and description only. It is not intended to be exhaustive or to be limited to the precise form disclosed.

Figure 1:
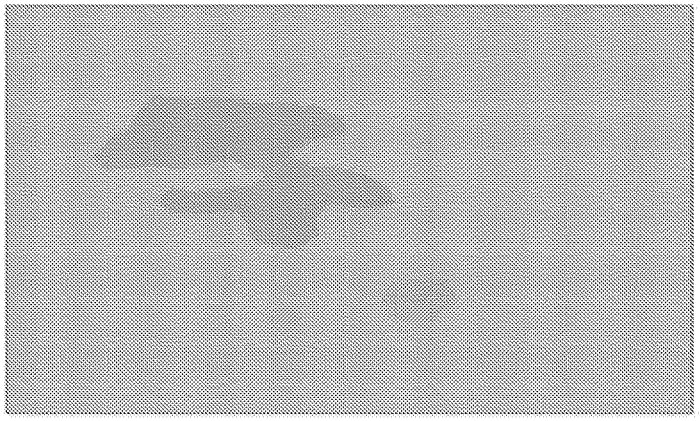
FIG. 1 is an image displayed by a display panel having mura defects.
Figure 2:
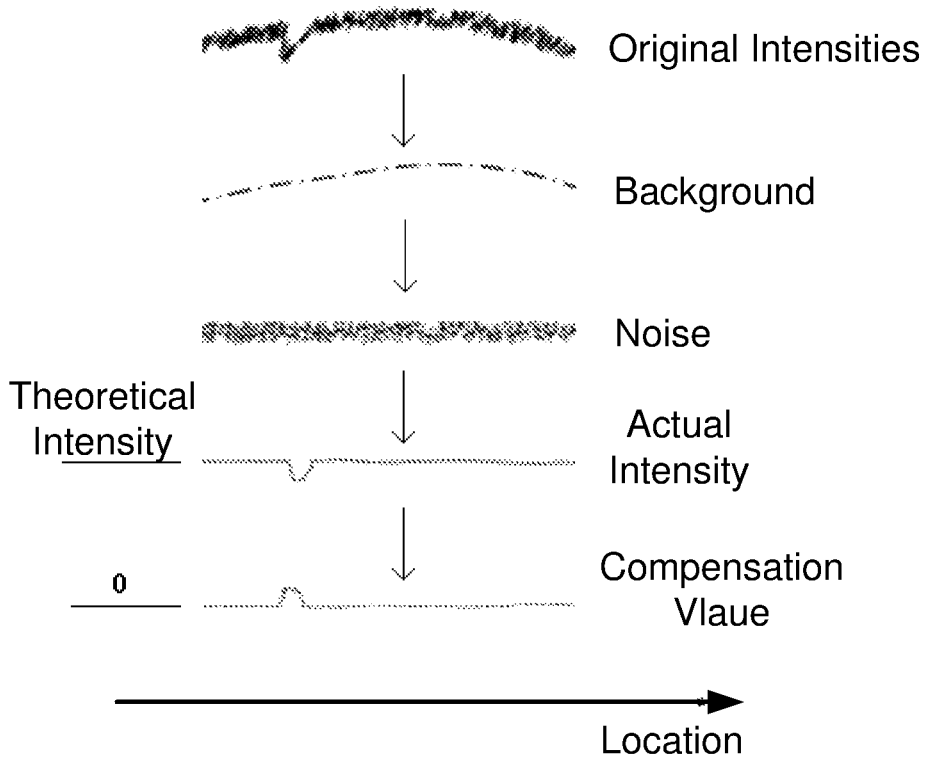
FIG. 2 is a schematic diagram illustrating a process for obtaining grayscale correction values for a row of pixels.

In some embodiments, the mura defects may be compensated in order to improve display quality. For example, an image of a display panel having mura defects is taken. The luminance of each pixel of the image is processed to obtain a measured luminance of each pixel, e.g., by removing background signal and reducing noise signal (see, e.g., FIG. 2). The measured luminance of each pixel is then compared with a theoretical luminance calculated based on the display data provided to each pixel, to generate a luminance difference between the measured luminance and corresponding theoretical value. A compensation value (e.g., a grayscale correction coefficient) for each pixel may be derived from the luminance difference.

Figure 3:
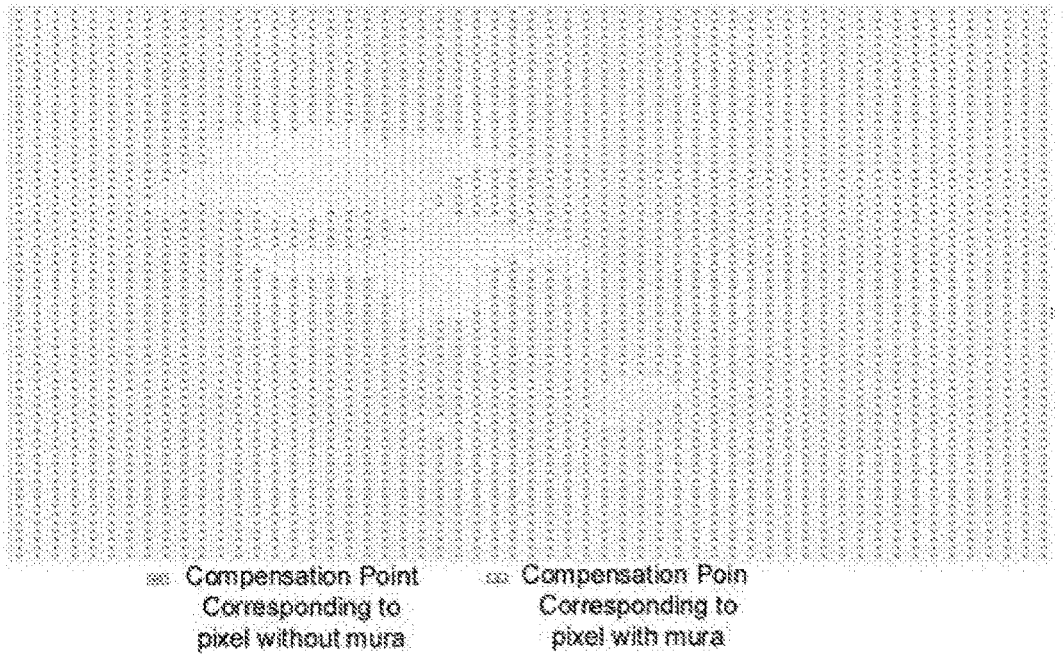
FIG. 3 is a schematic diagram of a compensation data table in some embodiments.
Figure 4:
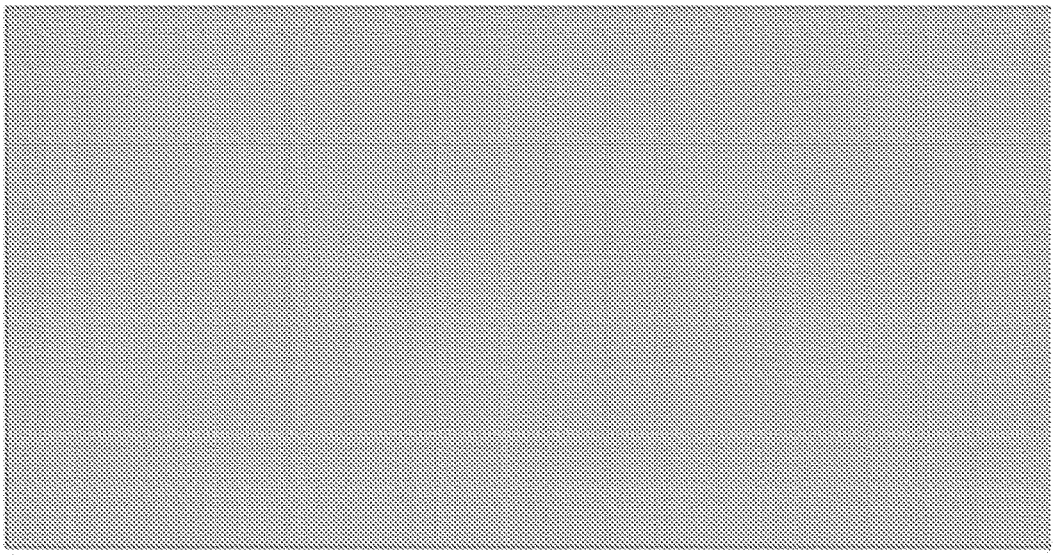
FIG. 4 is an image displayed by a display panel with mura compensation.

A compensation data table may be generated for the purposed of compensating mura defects. FIG. 3 is a schematic diagram of a compensation data table in some embodiments. Referring to FIG. 3, the compensation data table in the embodiment includes a plurality of compensation points. Each compensation point corresponds to a pixel associated with a compensation value, i.e., every pixel in the display image is provided with a compensation value. As shown in FIG. 3, the compensation points corresponding to pixels with and without mura defects are depicted in two different types of patterns. During image display in a display panel, the address (i.e., location of the pixel within the display panel) and display data (such as grayscale levels) for each pixel are obtained, a compensation value associated with each compensation point is assigned to each pixel. The display data for each pixel is compensated by the assigned compensation value, and the compensated display data for each pixel is used to drive the pixel for display the corresponding pixel of image. FIG. 4 is an image displayed by a display panel with mum compensation.

In some embodiments, the display data includes a grayscale levels. Optionally, the compensation value is a grayscale correction value, e.g., a grayscale correction value for adding to (e.g., adding a value of 10 to), or subtracting from (e.g., subtracting a value of 5 from), the grayscale level of a pixel. Optionally, the compensation value is a grayscale correction coefficient (e.g., a value of 1.03 or 0.98) for multiplying the grayscale level of a pixel. Pixels having different display data (e.g., different grayscale levels) may have different corresponding compensation values, respectively. For example, a grayscale level 100 of a first pixel may be compensated by addition of a grayscale correction value of 10, a grayscale level 200 of a second pixel may be compensated by addition of a grayscale correction value of 20, and a grayscale level between 100 and 200 of a third pixel may be compensated by addition of a grayscale correction value between 10 and 20.

In some embodiments, a compensation value is assigned to each pixel based on the compensation values provided in the compensation data table. Optionally, a compensation value having minimal or no compensating effect (e.g., a grayscale correction value of 0 or a grayscale correction coefficient of 1) is assigned to a pixel in the regions having no mura defects. This embodiment requires a large storage space for storing a compensation data table having an enormous amount of compensation data. For example, about 2 million compensation values for compensating grayscale levels alone are required for a full high definition display panel having 1920×1080 pixels. The amount of computation needed for performing compensation for every single pixel on the display is very large.

In one aspect, the present disclosure provides a novel and superior device and method for efficiently and effectively compensating mura defects, obviating the need for a large storage space and heavy computation.

In one aspect, the present disclosure provides a controller for compensating mura defects in a display image. FIG. 5 through FIG. 8 illustrate the basic structure of the mura compensating controller in some embodiments. In some embodiments, the present mura compensating controller includes at least a collection sub-controller, a storage sub-controller, a judgment sub-controller, and a compensation sub-controller. The present mura compensation controller is configured to perform mura compensation on original display data (e.g., display data received from a display driver card), generates compensated display data, and display an image based on the compensated display data that eliminate mura defects. Optionally, the mura compensating controller is implemented with a display panel.

In some embodiments, the collection sub-controller is a sub-controller for obtaining a plurality of display data and a plurality of address data corresponding to a plurality of display pixels (e.g., display pixels in a display panel). For example, the plurality of display data and the plurality of address data corresponding to a plurality of display pixels may be extracted, pixel-by-pixel, from original image display data received from a display driver card. Optionally, the collection sub-controller outputs the plurality of address data to the judgment sub-controller. Optionally, the collection sub-controller outputs display data of at least a selected group of pixels (e.g., a plurality of sampling pixels) to the compensation sub-controller. The plurality of sampling pixels constitute only a portion of the display pixels. For example, the plurality of sampling pixels may include primarily a plurality of display pixels having mura defects. Optionally, the plurality of sampling pixels include solely a plurality of display pixels having mura defects. Optionally, all display pixels having mura defects are included in the plurality of sampling pixels. Optionally, a plurality of original display data having no mura defects are used for image display without compensation. Optionally, all original display data having no mura defects are used directly for image display without compensation.

In some embodiments, the display data refers to data of display contents of a pixel, including data of display contents of multiple sub pixels of the pixel. Examples of display data include a grayscale level value, a luminance value, a driving voltage value, and so on. A display data commonly used in display field is the grayscale level value, which is a value characterizing image pixel luminance level.

In some embodiments, the address data refers to data of a physical location of a pixel. The address data may be represented by (x, y) coordinates, serial numbers, or any other appropriate forms for describing the physical location of the pixel in a display panel.

The storage sub-controller is configured to store a data table. For example, the data table may contain data in digital format stored in a non-volatile memory device. The data table includes a plurality of data points (e.g., a plurality of compensation points) and a plurality of compensation data associated with the plurality of compensation points corresponding to a plurality of sampling pixels. The plurality of sampling pixels constitute only a portion (e.g., less than 50%) of the plurality of display pixels. For example, the plurality of sampling pixels may include a plurality of display pixels having mura defects. Thus, each compensation point includes a compensation data for performing mura compensation computation. Each compensation data includes a compensation value assigned to each sampling pixel for compensating mura defects. A same compensation value may be used for different display data. Alternatively, different compensation values may be used for different display data for different sampling pixels. Optionally, different compensation values may be used for different display data for a same sampling pixel.

Each compensation point corresponds to one group of sampling pixels. Optionally, a group of sampling pixels includes only one sampling pixel. Optionally, a group of sampling pixels includes a plurality of sampling pixels. Optionally, each group of sampling pixels includes only one sampling pixel. Optionally, each group of sampling pixels includes a plurality of sampling pixels. Conversely, a pixel corresponding to a compensation point is a sampling pixel, e.g., a sampling pixel within a group of sampling pixels. In some cases, the plurality of sampling pixels includes all pixels determined to have mura defects. The plurality of sampling pixels constitute only a portion of the plurality of display pixels, i.e., the plurality of display pixels includes the plurality of sampling pixels and at least some pixels determined not having mura defects. Optionally, the number of display pixels having mura defects is no greater than 50% of the number of the plurality of display pixels.

By including only a portion of the display pixels as the sampling pixels, the data table in the storage sub-controller only needs to store information associated with a portion of the display pixels (e.g., no greater than 50%, no greater than 40%, no greater than 30%, or no greater than 20%). The present mura compensation controller greatly reduces the amount of compensation data and the storage space required for compensating mura defects, obviating the need for heavy computation in compensating mura defects.

In some embodiments, one compensation point corresponds to a single sampling pixel, i.e., in a one-to-one relationship. Optionally, each sampling pixel is assigned a compensation value individually (see, e.g., FIGS. 7 and 8), i.e., each sampling pixel is assigned a compensation value associated with the compensation point corresponding to the sampling pixel.

In some embodiments, each compensation point can be associated with multiple sampling pixels. For example, each compensation point may be selected at a sampling interval for multiple sampling pixels. By taking this approach, the amount of compensation data and the storage space required for compensating mura defects may be further reduced. For example, for each row of contiguous 10 sampling pixels in a row, only two compensation points may be selected at positions corresponding to the first sampling pixel and the tenth sampling pixel from left to right. In some embodiments, compensation values are assigned to the sampling pixels at two ends of the each row, respectively. The compensation data having these compensation values is stored in the compensation data table. For sampling pixels between the two sampling pixels at two ends of the each row, their compensation values may be calculated in proportion to the two stored compensation values, based on their locations (addresses) relative to the two sampling pixels at two ends. For instance, a compensation value of 1 may be assigned to the first sampling pixel in a row, and a compensation value of 5.5 may be assigned to the tenth sampling pixel in the row. Accordingly, a compensation value of 1.5 may be assigned to the second sampling pixel in the row, and a compensation value of 4.5 may be assigned to the eighth sampling pixel in the row.

Various alternative embodiments may be practiced to assign compensation values. For example, in a 3×3 grid of nine sampling pixels, a single compensation point can be chosen at a sampling pixel located in the center of the 3×3 grid. Optionally, all nine sampling pixels can be assigned with a same value of the compensation data stored at the single compensation point.

The storage sub-controller is configured to provide information contained in the data table to the compensation sub-controller. Such information may include compensation data associated with each compensation point, as well as information on correlation between each compensation point and one or more sampling pixels). The judgment sub-controller is configured to determine whether a pixel is a sampling pixel, and in combination determines a group of sampling pixels that are subject to compensation computation by the compensation sub-controller. The compensation sub-controller assigns a compensation value derived from a corresponding compensation data stored in the storage sub-controller. Various alternative embodiments may be practiced to associate a compensation point with one or more sampling pixels. Each pixel determined to be a sampling pixel will be assigned a compensation value derived from a corresponding compensation data in one or more compensation point.

The compensation value assigned to each sampling pixel may be a numerical value. In some embodiments, the numerical value is a correction additive value, i.e., a correction value (either positive or negative) that is directly added to the original display data to perform the compensation. For example, the display data may be a grayscale level, and the compensation value may be a grayscale correction value of the grayscale level. For pixels determined to have no mura defects, the correction value would be zero, i.e., the compensation value does not change the original display data. Optionally, the compensation value for pixels having no mura defects are not stored in the data table.

In some embodiments, the numerical value is a correction coefficient, i.e., a multiplication factor of the original display data. For example, the display data may be a grayscale level, and the compensation value may be a grayscale correction factor to be multiplied with the grayscale level. For pixels determined to have no mura defects, the correction factor would be 1, i.e., the compensation value does not change the original display data. Optionally, the compensation value for pixels having no mura defects are not stored in the data table.

In some embodiments, the plurality of sampling pixels constitutes at least one polygon region in the display panel. The data table contains a plurality of address data corresponding to the plurality of sampling pixels, including a plurality of addresses data associated with a plurality of compensation points corresponding to of pixels at vertex points of the at least one polygon region.

Figure 6:
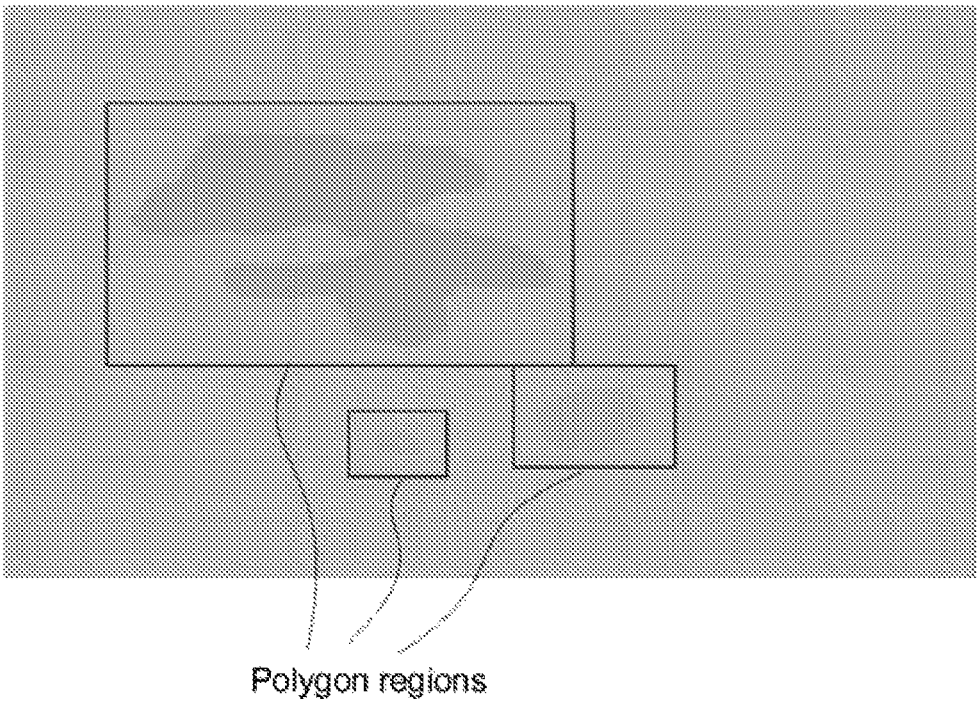
FIG. 6 is a schematic diagram illustrating a plurality of polygon regions selected based on a method compensating mura defects in some embodiments.
Figure 7:
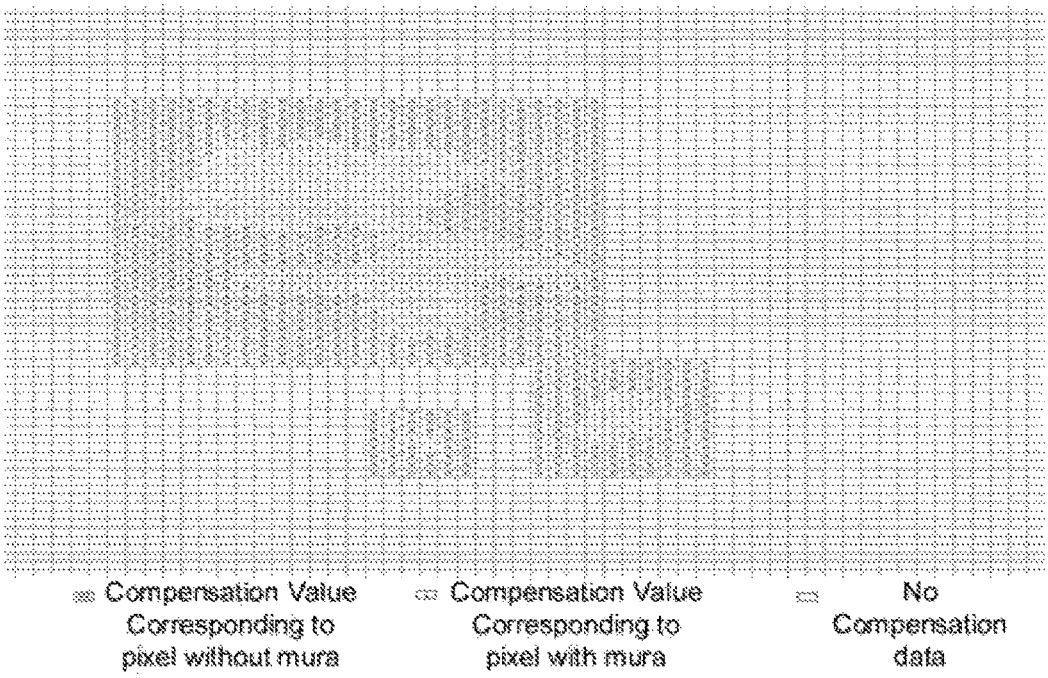
FIG. 7 is a schematic diagram illustrating a compensation data table implemented in a mura compensation controller in some embodiments.

As shown in FIGS. 6 and 7, all sampling pixels constitute one or more polygon regions. To ensure that all pixels having mura defects are included in the plurality of sampling pixels, the one or more polygon regions are selected such that all pixels having mura defects are within the one or more polygon regions. Based on the addresses of all compensation points corresponding to vertex points of the polygon regions, the shapes of the polygon regions and relative positions in the display panel may be determined. Further, the compensation data of the plurality of compensation points is arranged in a serial order. The sampling pixel corresponding to a compensation point may be identified by searching for sampling pixel linked to a particular serial number associated with the compensation point. For example, the row number and the column number of the sampling pixel corresponding to the compensation point may be identified by the serial number of the compensation point, and the correlation between the compensation point and the sampling pixel on the display panel may be determined accordingly.

In some embodiments, the data table records addresses of only a few selected compensation points instead of those of all compensation points. The information regarding remaining compensation points may be easily derived from their serial numbers. This design obviates the need for storing addresses of a large number of compensation points, further reducing the storage space required for the mura compensation controller.

Optionally, the polygon region is a rectangle region. Optionally, the sides of the polygon region overlap with rows and columns of the sampling pixels. Having the sides of the polygon region overlapping with rows and columns of the sampling pixels further simplifies the process of determining addresses of the compensation points and corresponding sampling pixels. Optionally, the polygon region is a triangular region.

Various embodiments may be practiced to select the polygon region. In some embodiments, each selected polygon region encompasses a single continuous area of pixels determined to have mura defects, i.e., isolated areas of pixels determined to have mura defects are included in different polygon regions, respectively (see, e.g., three polygon regions in FIG. 7). In some embodiments, each selected polygon region may encompasses one or more isolated areas of pixels determined to have mura defects if a distance between the isolated areas is less than a threshold distance (e.g., a cluster of isolated areas of pixels determined to have mura defects). Optionally, any two isolated areas of pixels determined to have mura defects are included in two polygon regions, respectively, if a distance between the two isolated areas is larger than the threshold distance. In some embodiments, a continuous area of pixels determined to have mura defects may be included in two or more adjacent polygon regions (e.g., two or more adjacent rectangular polygon regions). In some embodiments, a single polygon region may be selected to encompass all areas of pixels determined to have mura defects.

In some embodiments, the plurality of sampling pixels are a group of pixels consisting of all pixels determined to have mura defects. Optionally, the data table includes addresses of all compensation points. Optionally, the number of display pixels determined to have mura defects is no greater than 50% of the number of the plurality of display pixels.

Figure 8:
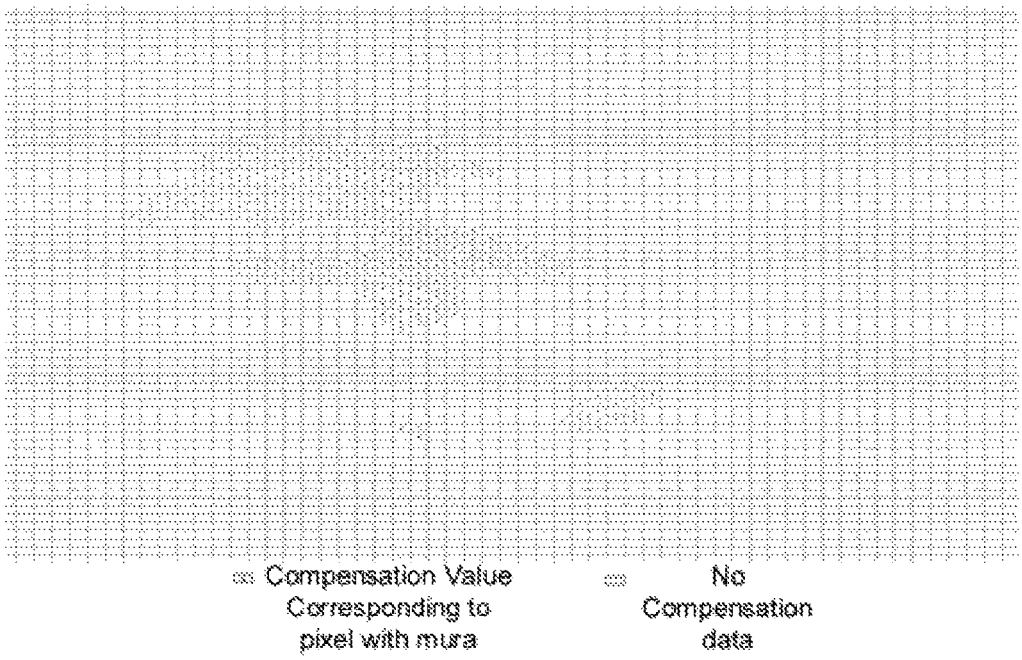
FIG. 8 is a schematic diagram illustrating a compensation data table implemented in a mura compensation controller in some embodiments.

As shown in FIG. 8, each sampling pixel is a pixel determined to have mura defects, and each pixel other than a sampling pixel is a pixel determined to have no mura defects. The data table contains exclusively information related to pixels determined to have mura defects. In some embodiments, the pixels determined to have mura defects are randomly distributed throughout the display panel, i.e., the sampling pixels are randomly distributed throughout the display panel. Optionally, addresses of all compensation points are recorded and stored in the data table for determining the correlation between a compensation point and a sampling pixel on the display panel. Typically, the number of pixels having mura defects is relatively small as compared to the number of display pixels.

In this embodiment, the compensation data table needs to store all addresses of all compensation points. In most application cases, as the display panel has relatively small number of pixels having mura defects, the corresponding quantity of addresses stored in the compensation data table is also small. Thus, this design obviates the need for storing addresses of a large number of compensation points corresponding to all display pixels, reducing the storage space required for the mura compensation controller.

Figure 5:
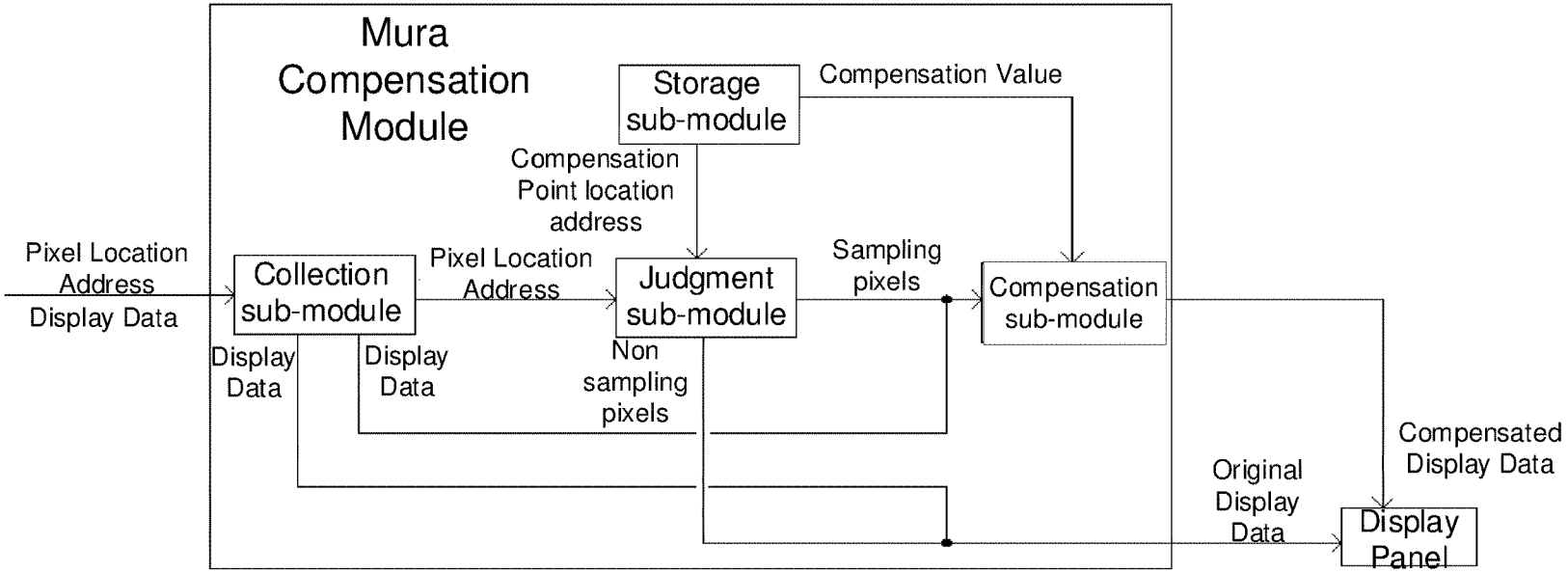
FIG. 5 is a block diagram of a mura compensation controller in some embodiments.

Referring to FIG. 5, the judgment sub-controller is configured to determine if a pixel is a sampling pixel, i.e., whether or not the data table contains a compensation point corresponding to the pixel. If the judgment sub-controller determines a pixel is a sampling pixel, a mura compensation operation is performed and a compensation value will be assigned to the pixel for compensating mura defects. Therefore, the mura compensation controller of the present disclosure is configured to perform mura compensation operations not on all but on a reduced number of pixels of the display panel so that the amount of compensation computation is reduced. Although the trade-off is an increased amount of computation for determining a pixel to be a sampling pixel, the amount of compensation computation is generally much larger than the amount of determination computation.

Referring to FIG. 5, the judgment sub-controller is coupled to the collection sub-controller to receive address data of each pixel of the display panel. In some embodiments, the plurality of sampling pixels are defined to outline at least one polygon region. In this case, the judgment sub-controller performs a judgment computation to determine whether a selected pixel is a sampling pixel, e.g., by checking if the address of the selected pixel falls into the polygon region simply based on a geometrical location information analysis. A pixel having an address within the polygon region is determined to be a sampling pixel. A pixel having an address outside of the polygon region is determined to be a pixel other than a sampling pixel.

Referring to FIG. 5, the judgment sub-controller is also coupled to the storage sub-controller to receive addresses of corresponding compensation points in the data table. In some embodiments, the plurality of sampling pixels are a group of pixels consisting of all pixels determined to have mura defects (i.e., each sampling pixel is a pixel having mura defects, and each non-sampling pixel is a pixel having no mura defects). In this case, the judgment sub-controller performs a judgment computation to determine whether a selected pixel is a sampling pixel, e.g., by checking if an address of a compensation point matches with the address data of the selected pixel. A pixel having a matching address data is determined to be a sampling pixel. A pixel having no matching address data is determined to be a pixel other than a sampling pixel. In case that every compensation point corresponds to a single sampling pixel in a one-to-one relationship, a pixel may be determined to be a sampling pixel if a matching address of a compensation point can be identified by searching through the data table. The judgment sub-controller outputs the judgment result, i.e., the plurality of sampling pixels and their corresponding addresses, to the compensation sub-controller.

The compensation sub-controller perform mura compensation operation on the plurality of sampling pixels to compensate mura defects of the original display data associated with these pixels. As shown in FIG. 5, the compensation sub-controller is coupled to judgment sub-controller to receive address information of the plurality of pixels determined to the plurality of sampling pixels. The compensation sub-controller is also coupled to the collection sub-controller to receive the original display data for the plurality of sampling pixels on which the mura compensation operation is to be performed. The compensation sub-controller is further coupled to the storage sub-controller to receive compensation data associated with compensation points corresponding to the plurality of sampling pixels. Having received all these information, the compensation sub-controller performs mura compensation operation to determine compensation values to be assigned to the plurality of sampling pixels. The compensation sub-controller then assigns the compensation values to the plurality of sampling pixels, and compensates the original display data by the assigned compensation value using a selected compensation methodology. The compensation sub-controller generates a compensated display data for each sampling pixel, and outputs the compensated display data to a display panel for image display. No compensation operation is performed on any of the non-sampling pixels. For non-sampling pixels, the original display data is transmitted directly to the display panel for image display.

Because no compensation operation is performed on non-sampling pixels, the amount of compensation computation is reduced. In some embodiments, the compensation operation includes identifying compensation points corresponding to the plurality of sampling pixels based on the address data of the plurality of sampling pixels; assigning a compensation value to each sampling pixel based on a compensation data associated with a compensation point corresponding to the sampling pixel; and compensating the display data of each sampling pixel by the assigned compensation value. For each type of display data (e.g., a grayscale level), a different compensation value may be used. The compensation data may contain multiple types of compensation values corresponding to different types of display data. For compensating a selected type of display data, a corresponding type of compensation value may be chosen. The compensation operation for each pixel may be performed by adding a correction value (positive or negative) directly to the original display data of the pixel, or by multiplying a correlation factor with the original display data of the pixel.

The amount of data and storage space required for performing the present mura compensation operation are reduced because the mura compensation operation are only performed on the plurality of sampling pixels. Nonetheless, the mura defects are effectively and efficiently compensated by including all pixels having mura defects in the mura compensation operation.

In another aspect, the present disclosure provides a display apparatus having the mura compensation controller as described herein and a display panel for displaying an image. The display panel is configured to display the image at each of the plurality of sampling pixels using a compensated display data, and at each of the plurality of non-sampling pixels using an original display data.

Examples of display apparatuses include, but are not limited to, a liquid crystal display panel, an electronic paper, an OLED display panel, a mobile phone, a tablet computer, a television set, a monitor, a notebook computer, a digital album, a navigation system, etc.

In another aspect, the present disclosure provides a method for compensating mura defects in display image. This method includes obtaining a plurality of display data and a plurality of address data corresponding to a plurality of display pixels; determining if a pixel is a sampling pixel based on a data table comprising a plurality of compensation data associated with a plurality of compensation points for compensating a plurality of sampling pixels, each compensation point corresponding to a group of at least one sampling pixel, the plurality of sampling pixels comprising a plurality of display pixels having mura defects and constituting a portion of the plurality of display pixels; and compensating a display data of the sampling pixel by assigning a compensation value to the sampling pixel based on a compensation data associated with a compensation point corresponding to the sampling pixel.

In some embodiments, the method for compensating mura defects is implemented by the mura compensation controller described herein (e.g., the mura compensation controller in FIG. 5). First, display data and address of each pixel are extracted and is determined whether it is a sampling pixel based on its address. If a pixel is determined to be a sampling pixel, a mura compensation operation is performed and a compensation value will be assigned to the pixel for compensating mura defects. If a pixel is determined to be a non-sampling pixel, no compensation operation is performed on the non-sampling pixel. For the non-sampling pixel, the original display data is transmitted directly to the display panel for image display.

Optionally, prior to the step of obtaining the plurality of display data and the plurality of address data, the method further comprises generating a data table. Once a display panel is produced, the compensation data table can be generated once and stored in a memory chip. The data table can then be directly used in all subsequent compensation operations.

In some embodiments, the step of generating the data table includes providing a plurality of testing display data to the plurality of display pixels for displaying a plurality of pixels of an image; measuring a luminance of each pixel of the image; calculating a luminance difference between a measured luminance and a theoretical luminance for each pixel; determining a pixel to be a pixel having mura defect if the luminance difference is larger than a threshold value; selecting the plurality of sampling pixels; and generating the plurality of compensation data associated with the plurality of compensation points based on the luminance difference for each pixel.

Optionally, the step of generating the data table includes providing a plurality of testing display data to the plurality of display pixels for displaying a plurality of pixels of an image. For example, the display panel is allowed to display each pixel of image based on original testing display data without any compensation to obtain an initial display image. Optionally, the display panel is provided with a plurality of testing display data that have substantially the same color and intensity for each pixel over the entire display panel.

Optionally, the step of generating the data table includes measuring a luminance of each pixel of the image. For example, the above-mentioned initial display image may be obtained (e.g., captured by a camera). The plurality of pixels of the image emitting from the plurality of display pixels are analyzed, and the luminance of each pixel of the image is measured. Optionally, the measuring step includes background elimination and noise reduction prior to obtaining measured luminance of the pixel.

Optionally, the step of generating the data table includes calculating a luminance difference between a measured luminance and a theoretical luminance for each pixel. The theoretical luminance is an estimated luminance value for each pixel assuming there is no mura defects at the pixel. If the luminance difference is larger than a threshold value (e.g., a value equivalent to error due to equipment inaccuracy), this pixel is determined to be a pixel having mura defect.

Optionally, the step of generating the data table includes determining a pixel to be a pixel having mura defect if the luminance difference is larger than a threshold value. Optionally, the plurality of sampling pixels include all pixels determined to have mura defects (i.e., every pixel having mura defects is a sampling pixel). The plurality of display pixels include the plurality of sampling pixels and a plurality of non-sampling pixels, i.e., a portion of the plurality of display pixels is constituted by the plurality of non-sampling pixels. In the present method, the data table is generated using addresses and luminance differences of only the sampling pixel instead of all display pixels. The information of non-sampling pixels are not used in generating the data table.

In some embodiments, the plurality of sampling pixels are a group of pixels consisting of all pixels determined to have mura defects (i.e., each sampling pixel is a pixel having mura defects, and each non-sampling pixel is a pixel having no mura defects).

In some embodiments, the plurality of sampling pixels are defined to outline at least one polygon region. All pixels in the at least one polygon region are sampling pixels. The at least one polygon region includes all pixels determined to have mura defects (i.e., each pixel having mura defects are within the at least one polygon region). Optionally, the at least one polygon region includes a margin region including a few additional rows and columns beyond a smallest polygon region formed by pixels determined to have mura defects.

Various methods may be practiced to select the polygon region. In some embodiments, each polygon region is selected to encompass a single continuous area of pixels determined to have mura defects, i.e., isolated areas of pixels determined to have mum defects are included in different polygon regions, respectively (see, e.g., three polygon regions in FIG. 7). In some embodiments, each polygon region is selected to encompass one or more isolated areas of pixels determined to have mum defects if a distance between the isolated areas is less than a threshold distance (e.g., a cluster of isolated areas of pixels determined to have mura defects). Optionally, two polygon regions are selected to encompass any two isolated areas of pixels determined to have mura defects if a distance between the two isolated areas is larger than the threshold distance. In some embodiments, two or more adjacent polygon regions (e.g., two or more adjacent rectangular polygon regions) are selected to encompass a continuous area of pixels determined to have mura defects. In some embodiments, a single polygon region is selected to encompass all areas of pixels determined to have mura defects.

Optionally, the step of generating the data table includes generating the plurality of compensation data associated with the plurality of compensation points based on the luminance difference for each pixel. For example, a data table having the plurality of compensation data associated with the plurality of compensation points may be generated based in part on the luminance difference and address for each sampling pixel. Optionally, the data table includes the plurality of compensation points, the plurality of compensation data associated with the plurality of compensation points, and a plurality of addresses of at least a portion of compensation points.

Optionally, the step of generating the data table further includes determining a correlation relationship between the compensation points and sampling pixels (e.g., a one-to-one relationship or each compensation point correlated with multiple sampling pixels); determining the compensation point corresponding to the sampling pixel; and generating a compensation data associated with each compensation point based on the luminance difference for each pixel correlated to the compensation point. For a compensation point corresponding to a pixel having mura defects, the compensation data is calculated based on the luminance difference for the pixel. For a compensation point corresponding to a pixel having no mura defects, the compensation value does not change the original display data, e.g., the compensation value may be a correction additive value of zero or a correction coefficient of one.

In another aspect, the present disclosure also provides a display method. In some embodiments, the display method includes compensating mura defects in a display image according to a method for compensating mura defects in a display image described herein; and displaying an image at each of the plurality of sampling pixels using a compensated display data, and at each of pixels other than sampling pixels using a display data.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for compensating mura defects in a display image comprising:

selecting a plurality of sampling pixels by selecting at least one polygon region to include all pixels determined to have mura defects, pixels within the at least one polygon region are defined as the plurality of sampling pixels;

obtaining a plurality of display data and a plurality of address data corresponding to a plurality of display pixels; and determining if a pixel is a sampling pixel based on a data table comprising a plurality of compensation data associated with a plurality of compensation points for compensating a plurality of sampling pixels, a respective one of the plurality of compensation points corresponding to a group of at least one sampling pixel, the plurality of sampling pixels comprising a plurality of display pixels having mura defects and constituting a portion of the plurality of display pixels;

wherein a respective one of the at least one polygon region is selected to encompass one or more isolated areas of pixels determined to have mura defects if a distance between isolated areas is less than a threshold distance.

2. The method of claim 1, prior to the step of obtaining the plurality of display data and the plurality of address data, further comprising:

providing a plurality of testing display data to the plurality of display pixels for displaying a plurality of pixels of an image;

measuring a luminance of a respective one of the plurality of pixels of the image;

calculating a luminance difference between a measured luminance and a theoretical luminance for the respective one of the plurality of pixels;

determining a pixel to be a pixel having mura defect if the luminance difference is larger than a threshold value;

generating the plurality of compensation data associated with the plurality of compensation points based on the luminance difference for the respective one of the plurality of pixels.

3. The method of claim 1, further comprising compensating a display data of the sampling pixel by assigning a compensation value to the group of at least one sampling pixel based on a compensation data associated with a compensation point corresponding to the group of at least one sampling pixel.

4. The method of claim 1, wherein the step of determining if a pixel is a sampling pixel comprises determining if the pixel is within the at least one polygon region based on the address data of the pixel.

5. The method of claim 1, wherein the data table comprises a plurality of addresses data associated with a plurality of compensation points corresponding to pixels at vertex points of the at least one polygon region.

6. The method of claim 1, wherein the step of selecting the plurality of sampling pixels comprises selecting a group of pixels consisting of all pixels determined to have mura defects as the plurality of sampling pixels.

7. The method of claim 6, wherein the step of determining if a pixel is a sampling pixel comprises matching the address data of the pixel with those of the plurality of compensation points.

8. A display method for displaying an image on a display panel comprising:

selecting a plurality of sampling pixels by selecting at least one polygon region to include all pixels determined to have mura defects, pixels within the at least one polygon region are defined as the plurality of sampling pixels;

obtaining a plurality of display data and a plurality of address data corresponding to a plurality of display pixels;

determining if a pixel is a sampling pixel based on a data table comprising a plurality of compensation data associated with a plurality of compensation points for compensating the plurality of sampling pixels, a respective one of the plurality of compensation points corresponding to a group of at least one sampling pixel, the plurality of sampling pixels comprising a plurality of display pixels having mura defects and constituting a portion of the plurality of display pixels;

compensating a display data of the sampling pixel by assigning a compensation value to the group of at least one sampling pixel based on a compensation data associated with a compensation point corresponding to the group of at least one sampling pixel; and displaying an image at a respective one of the plurality of sampling pixels using a compensated display data, and at a respective one of pixels other than sampling pixels using a display data;

wherein a respective one of the at least one polygon region is selected to encompass one or more isolated areas of pixels determined to have mura defects if a distance between isolated areas is less than a threshold distance.

9. A controller for compensating mura defects in a display image comprising:

a collection sub-controller for obtaining a plurality of display data and a plurality of address data corresponding to a plurality of display pixels;

a storage sub-controller for storing a data table comprising a plurality of compensation data associated with a plurality of compensation points for compensating a plurality of sampling pixels, a respective one of the plurality of compensation points corresponding to a group of at least one sampling pixel, the plurality of sampling pixels comprising a plurality of display pixels having mura defects and constituting a portion of the plurality of display pixels;

a judgment sub-controller coupled to the collection sub-controller for receiving the plurality of address data, and coupled to the storage sub-controller for determining if a pixel is a sampling pixel; and a compensation sub-controller coupled to the storage sub-controller, the judgment sub-controller, and the collection sub-controller for compensating a display data of the sampling pixel by assigning a compensation value to the group of at least one sampling pixel based on a compensation data associated with a compensation point corresponding to the group of at least one sampling pixel;

wherein the plurality of sampling pixels outline at least one polygon region, wherein the data table comprises a plurality of addresses data associated with a plurality of compensation points corresponding to pixels at vertex points of the at least one polygon region; and a respective one of the at least one polygon region is selected to encompass one or more isolated areas of pixels determined to have mura defects if a distance between isolated areas is less than a threshold distance.

10. The controller of claim 9, wherein the at least one polygon region is at least one rectangular region.

11. The controller of claim 9, wherein the judgment sub-controller is configured to determine the pixel to be the sampling pixel if the pixel is within the at least one polygon region based on the address data of the pixel.

12. The controller of claim 9, wherein the plurality of sampling pixels consist of the plurality of display pixels having mura defects, and the data table comprises a plurality of address data associated with the plurality of compensation points corresponding to the plurality of sampling pixels.

13. The controller of claim 9, wherein the judgment sub-controller is configured to determine the pixel to be the sampling pixel by matching the address data of the pixel with those of the plurality of compensation points.

14. The controller of claim 9, wherein the compensation value comprises one of a correction value to be added to the display data for compensating mura defects of the sampling pixel and a correction factor to be multiplied with the display data for compensating mura defects of the sampling pixel.

15. A display apparatus comprising:

the controller of claim 9; and a display panel for displaying an image; wherein the display panel is configured to display the image at a respective one of the plurality of sampling pixels using a compensated display data.

* * * * *